US007480468B2

(12) United States Patent
Shin et al.

(10) Patent No.: US 7,480,468 B2
(45) Date of Patent: Jan. 20, 2009

(54) APPARATUS FOR DETECTING DEVELOPER LEVEL IN DEVELOPING UNIT

(75) Inventors: Joong-gwang Shin, Seongnam-si (KR); Ki-ju Pak, Yongin-si (KR); Jean-man Sur, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 50 days.

(21) Appl. No.: 11/588,303

(22) Filed: Oct. 27, 2006

(65) Prior Publication Data

US 2007/0147857 A1 Jun. 28, 2007

(30) Foreign Application Priority Data

Dec. 23, 2005 (KR) ..... 10-2005-0128707

(51) Int. Cl.
*G03G 15/08* (2006.01)

(52) U.S. Cl. ..... 399/27; 399/64; 399/98

(58) Field of Classification Search ..... 399/27, 399/61, 64, 98; 356/627; 206/316.1; 15/1.51
See application file for complete search history.

(56) References Cited

U.S. PATENT DOCUMENTS

| | | | | |
|---|---|---|---|---|
| 5,412,279 | A * | 5/1995 | De Boer | 313/479 |
| 5,752,126 | A * | 5/1998 | Muramatsu | 399/44 |
| 5,773,150 | A * | 6/1998 | Tong et al. | 428/429 |
| 2003/0096119 | A1* | 5/2003 | Kimura et al. | 428/412 |
| 2004/0227128 | A1* | 11/2004 | Reuter et al. | 252/299.01 |
| 2006/0071201 | A1* | 4/2006 | Jonas et al. | 252/500 |
| 2007/0031660 | A1* | 2/2007 | Kanamaru et al. | 428/355 AC |

FOREIGN PATENT DOCUMENTS

| | | |
|---|---|---|
| CN | 1135444 | 1/2004 |
| CN | 1495568 | 5/2004 |
| JP | 64-038779 | 2/1989 |
| JP | 05-107925 | 4/1993 |

(Continued)

OTHER PUBLICATIONS

Machine translation of JP 07-056431 A dated May 6, 2008.*

*Primary Examiner*—Sophia S Chen
(74) *Attorney, Agent, or Firm*—Roylance, Abrams, Berdo & Goodman, L.L.P.

(57) ABSTRACT

An apparatus to detect the remaining amount of developer in a developing unit is provided. The apparatus includes a light emitting prism and a light receiving prism placed opposite to each other in a developer store space of the developing unit and forming a light emitting path and a light receiving path, respectively. A light emitting element irradiates light through the light emitting prism, and a light receiving element receives a light signal through the light receiving prism. An antistatic agent is coated on a light emitting window of the light emitting prism and a light receiving window of the light receiving prism, respectively, to substantially prevent developer from attaching on the light emitting window and the light receiving window. Because the developer is not stuck on the light receiving window and the light emitting window to which the light signal is transmitted, an accurate light signal may be transmitted from the light emitting window to the light receiving window, thereby substantially preventing printing defects caused by detection errors from occurring.

30 Claims, 4 Drawing Sheets

FOREIGN PATENT DOCUMENTS

| | | |
|---|---|---|
| JP | 07-056431 | 3/1995 |
| JP | 2000-146827 | 5/2000 |
| JP | 2000-258985 | 9/2000 |
| JP | 2001-075353 | 3/2001 |
| JP | 2003-322985 | 11/2003 |
| JP | 2005-070646 | 3/2005 |
| JP | 2005-082784 | 3/2005 |
| KR | 98-3929 | 3/1998 |

* cited by examiner

APPARATUS FOR DETECTING DEVELOPER LEVEL IN DEVELOPING UNIT

CROSS-REFERENCE TO RELATED PATENT APPLICATIONS

This application claims the benefit under 35 U.S.C. § 119 (a) of Korean Patent Application No. 10-2005-0128707, filed on Dec. 23, 2005, in the Korean Intellectual Property Office, the entire disclosure of which is hereby incorporated by reference.

BACKGROUND OF THE INVENTION

1. Field of the Invention

The present invention relates to an apparatus to detect the remaining amount of developer in a developing unit. More particularly, the present invention relates to an apparatus to detect developer level using an optical sensor.

2. Description of the Related Art

Generally, in an electrophotographic image forming apparatus, such as a laser beam printer, a developing unit develops an electrostatic latent image formed on a surface of a photosensitive medium with developer. The developed image is then transferred onto a paper sheet. That is, the developer supplied from the developing unit is stuck on the electrostatic latent image of the photosensitive medium and developed into a visible image, and the image is transferred onto the paper sheet. Thus, a printing operation is performed. To continuously perform such a printing operation, the developer must be continuously supplemented in the developing unit.

To supplement the developer, a unit to detect the remaining amount of developer in the developing unit has been commonly used. Conventionally, an optical sensor, installed on a bottom surface of the developing unit, generates an exhaustion signal indicating that the developer is almost exhausted. The optical sensor has a light emitting element and a light receiving element placed opposite to the light emitting element. When developer exists between the light emitting element and the light receiving element, the exhaustion signal is not generated. When the developer is almost exhausted and no developer exists between the light emitting element and the light receiving element, light is transmitted from the light emitting element to the light receiving element and the exhaustion signal is generated.

However, in the conventional method, the exhaustion signal is generated and a process of supplementing developer is performed only when the developer is almost exhausted. Thus, due to developer shortage, an image being printed on a piece of paper may be of low quality. Additionally, due to static electricity, the developer might be stuck on a light emitting surface of the light emitting element and a light receiving surface of the light receiving element. Thus, even when the developer is almost exhausted, due to the stuck developer, there is a high probability to wrongly determine that there is enough developer. Accordingly, because the developer is not supplemented at an appropriate time, low quality images may be printed.

To address this problem, a detecting apparatus that timely, precisely, and stably detects the developer level is needed.

SUMMARY OF THE INVENTION

The exemplary embodiments of the present invention provide an apparatus to detect a developer level that precisely detects the level of developer in a developing unit even when developer is stuck on a light emitting element or a light receiving element.

According to an aspect of the present invention, an apparatus detects developer level in a developing unit. The apparatus comprises a light emitting prism and a light receiving prism placed opposite to each other in a developer store space of the developing unit and forming a light emitting path and a light receiving path, respectively. A light emitting element irradiates light through the light emitting prism. A light receiving element receives a light signal through the light emitting prism. An antistatic agent is coated on a light emitting window of the light emitting prism and a light receiving window of the light receiving prism, respectively, to substantially prevent developer from attaching on the light emitting window and the light receiving window.

The antistatic agent may be prepared by diluting polythiophene-based pigments in distilled water or isopropyl alcohol. A surface resistance of the antistatic agent is preferably less than approximately $10^5$ ohm/mm$^2$ and a coating thickness thereof is preferably less than approximately 5.0 μm.

A remaining amount of developer may be determined according to a range of a light receiving amount detected by the light receiving element.

The apparatus may further include a cleaning tool to clean the light emitting window and the light receiving window. The cleaning tool may include a cleaning blade installed in a predetermined rotating member to contact the light emitting window and the light receiving window, respectively. The light emitting window and the light receiving window are cleaned according to the rotation of the rotating member. The rotating member may be an auger rotating in the developer store space and conveying the developer in a predetermined direction.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
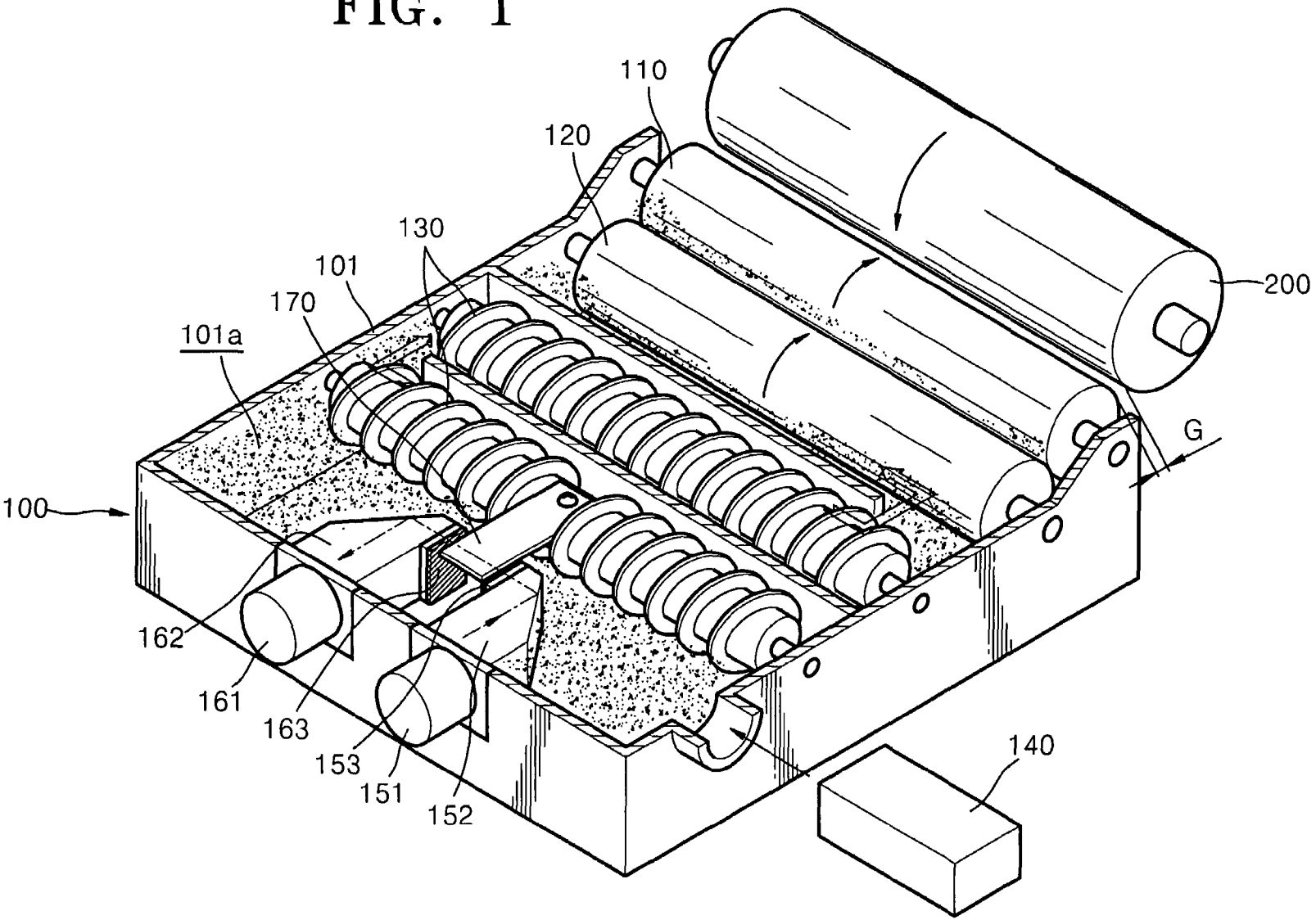
FIG. 1 is a perspective view of a developing unit having an apparatus to detect developer level according to an exemplary embodiment of the present invention.
Figure 5:
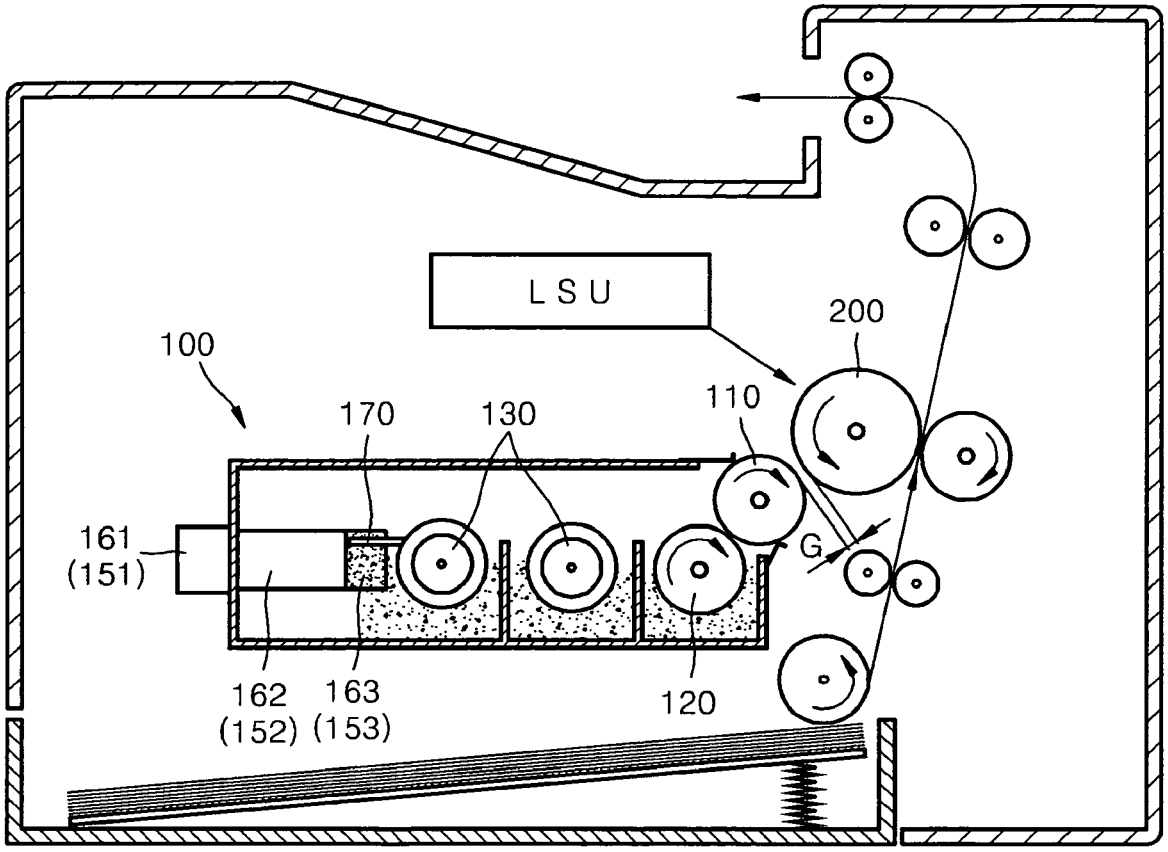
FIG. 5 is an elevational view of an image forming apparatus including a developing unit according to an exemplary embodiment of the present invention.

FIG. 1 is a perspective view of a developing unit 100 having an apparatus to detect developer level according to an exemplary embodiment of the present invention. FIG. 5 is an elevational view in partial cross section of an image forming apparatus incorporating such a developing unit 100. Referring to FIG. 1, the developing unit 100 includes a main body 101 having a developer store space 101*a*. A developing roller 110 is disposed opposite to a photosensitive body 200 with a predetermined gap G therebetween. A supplying roller 120 supplies developer to the developing roller 110. Two augers 130 feed the developer from the developer store space 101*a* to the supplying roller 120. When a developing operation is performed, the augers 130 are rotated, the developer is fed from the spirals of the augers 130 to a region in which the supplying roller 120 is disposed, and the supplying roller 120 supplies the developer onto the surface of the developing roller 110. Then, the developer stuck onto the surface of the developing roller 110 is stuck onto an electrostatic latent image formed on the photosensitive body 200, thereby developing the electrostatic latent image into a visible image.

The apparatus to detect a developer level according to exemplary embodiments of the present invention includes prisms 152 and 162, which are installed in the developer store space 101*a*, and a light emitting element 151 and a light receiving element 161 that are installed outside the developer store space 101*a*. That is, the prism 152 forms a light path for light emitted by the light emitting element 151, and the prism 162 forms a light path for the light receiving element 161. The prisms 152 and 162 are opposite to each other and installed inside the developer store space 101*a*. Thus, when light is emitted from the light emitting element 151, the light passes through the prism 152 and the prism 162 and is incident on the light receiving element 161. Thus, the remaining amount of developer in the developer store space 101*a* may be determined. For example, when the developer is full between a light emitting window 153 of the prism 152 and a light receiving window 163 of the prism 162, the light emitted from the light emitting element 151 does not transmit to the light receiving window 163 from the light emitting window 153. Thus, a light signal is not detected by the light receiving element 161. Thus, in this case, it is determined that there is enough developer in the developer store space 101*a*. That is, the remaining amount of developer may be determined depending on whether a light signal is received or not. For example, when no light signal is received or the voltage level thereof is less than 0.3 V, the developer level is high. When the voltage level of the light signal is in the range of 0.3-2.0 V, the developer is in a normal state. When a voltage level of the light signal is in the range of 2.0-3.0 V, the developer level is low. When a light signal is greater than 3.0 V, the developer is empty. Thus, the remaining amount of the developer may be detected. Thus, when the developer level is low, a controller (not shown) opens a path through which a developer supplying member or tub 140 is connected to the controller, to supply the developer into the main body 101 of the developing unit 100. When the developer store space 101*a* is empty, the developer supplying tub 140 is also empty. Thus, a message that informs a user that the developer supplying tub 140 should be replaced is displayed.

Figure 2:
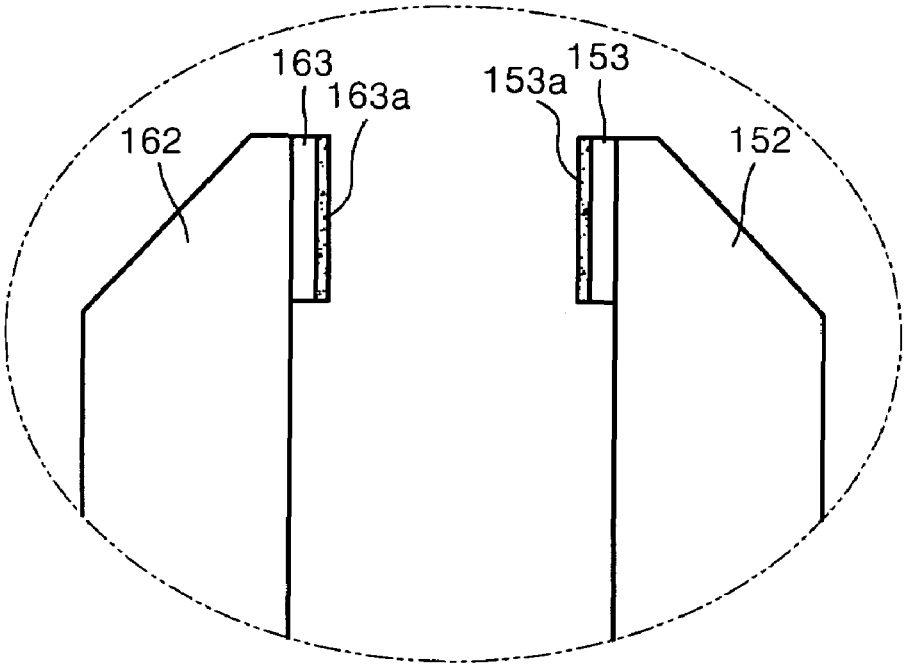
FIG. 2 is an elevational view of a coating layer disposed on a light receiving window and a light emitting window of the developing unit of FIG. 1.

Antistatic coating layers 153*a* and 163*a* are formed on the light emitting window 153 and the light receiving window 163, respectively, as shown in FIG. 2. The antistatic coating layers 153*a* and 163*a* are used to prevent errors from occurring in light signal transmission due to developer particles being stuck onto the light emitting window 153 and the light receiving window 163. For example, an antistatic agent that is prepared by diluting polythiophene-based pigments in distilled water or isopropyl alcohol is coated to a thickness less than approximately 5.0 μm. Thus, a surface resistance of the light emitting window 153 is less than approximately $10^5$ ohm/mm$^2$, and the charged developer particles are not stuck onto the light emitting window 153 and the light receiving window 163. Thus, because the light emitting window 153 and the light receiving window 163 are not substantially contaminated by the developer, the remaining amount of developer may be more precisely recognized. That is, if the antistatic agent is not coated on the windows 153 and 163, a large amount of developer particles are stuck onto the light receiving window 163 and the light emitting window 153 due to static electricity. Thus, even when the developer is almost exhausted, the possibility of wrongly detecting that the developer is sufficient is high. However, when the antistatic agent is coated, the developer is not stuck onto the light receiving window 163 and the light emitting window 153, and a change of the amount of light matches more precisely a change in the developer level.

Figure 3:
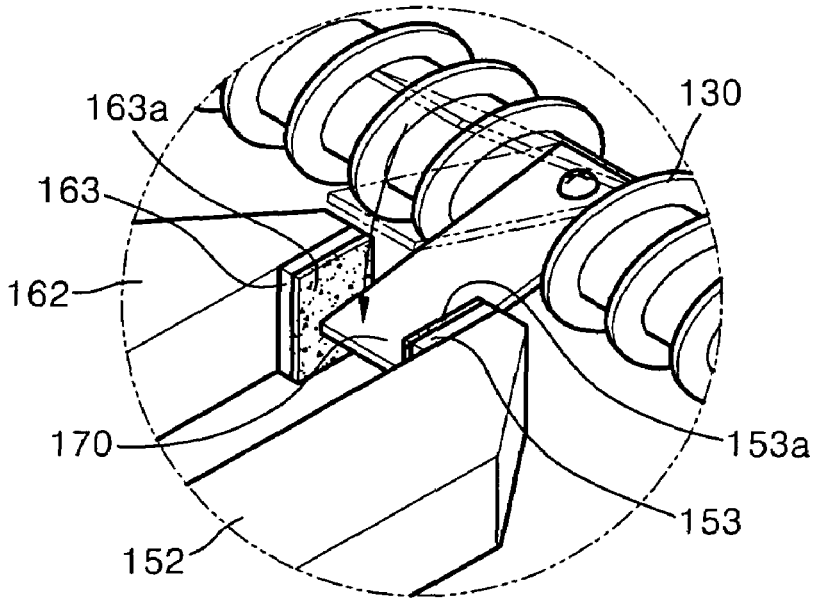
FIG. 3 is a perspective view of a cleaning tool for the light receiving window and the light emitting window of the developing unit of FIG. 1.

In addition to the antistatic agent, a cleaning tool to clean the light emitting window 153 and the light receiving window 163 is provided. When the antistatic coating layers 153*a* and 163*a* are formed, the possibility for wrongly detecting that the developer is sufficient using the optical sensor is sufficiently prevented, but the cleaning tool to continuously clean the light emitting window 153 and the light receiving window 163 is installed to stably maintain the detection characteristics of the optical sensor. According to an exemplary embodiment of the present invention, as shown in FIG. 1, the cleaning tool is a cleaning blade 170 installed at the augers 130. That is, the cleaning blade 170 is preferably formed of rubber and connected to an auger 130 to rotate with the auger 130, thereby cleaning the light emitting window 153 and the light receiving window 163, as illustrated in FIG. 3. An additional rotating body may be installed and the cleaning blade 170 may be attached to that rotating body. However, a cleaning tool is very simply realized by utilizing the existing augers 130.

Operation of the developing unit having the apparatus to detect a developer level is as follows.

When a developing operation is performed, as described above, the augers 130 are rotated, and developer is conveyed to a region in which the supplying roller 120 is disposed. The supplying roller 120 supplies the developer onto the surface of the developing roller 110, and the developing roller 110 transfers the developer to the electrostatic latent image of the photosensitive body 200 at a developing gap G. Thus, an image is developed on the photosensitive body 200.

While the developing operation is being performed, the light emitting element 151 emits light through the prism 152 and the light receiving element 161 receives a light signal through the prism 162. The amount of the developer that remains in the developer store space 101*a* of the main body 101 is detected in accordance with the amount of light received by the light receiving element 161. As described above, the developer level may be classified into four steps, such as full, normal, low, and empty according to the degree of the amount of received light, and a controller (not shown) may display a corresponding message. Due to the antistatic coating layers 153*a* and 163*a*, the developer is not stuck onto the light emitting window 153 and the light receiving window 163 of the two prisms 152 and 162. The cleaning blade 170 continuously cleans the light emitting window 153 and the light receiving window 163 so that a state in which a light signal may be precisely transmitted is maintained.

Figure 4:
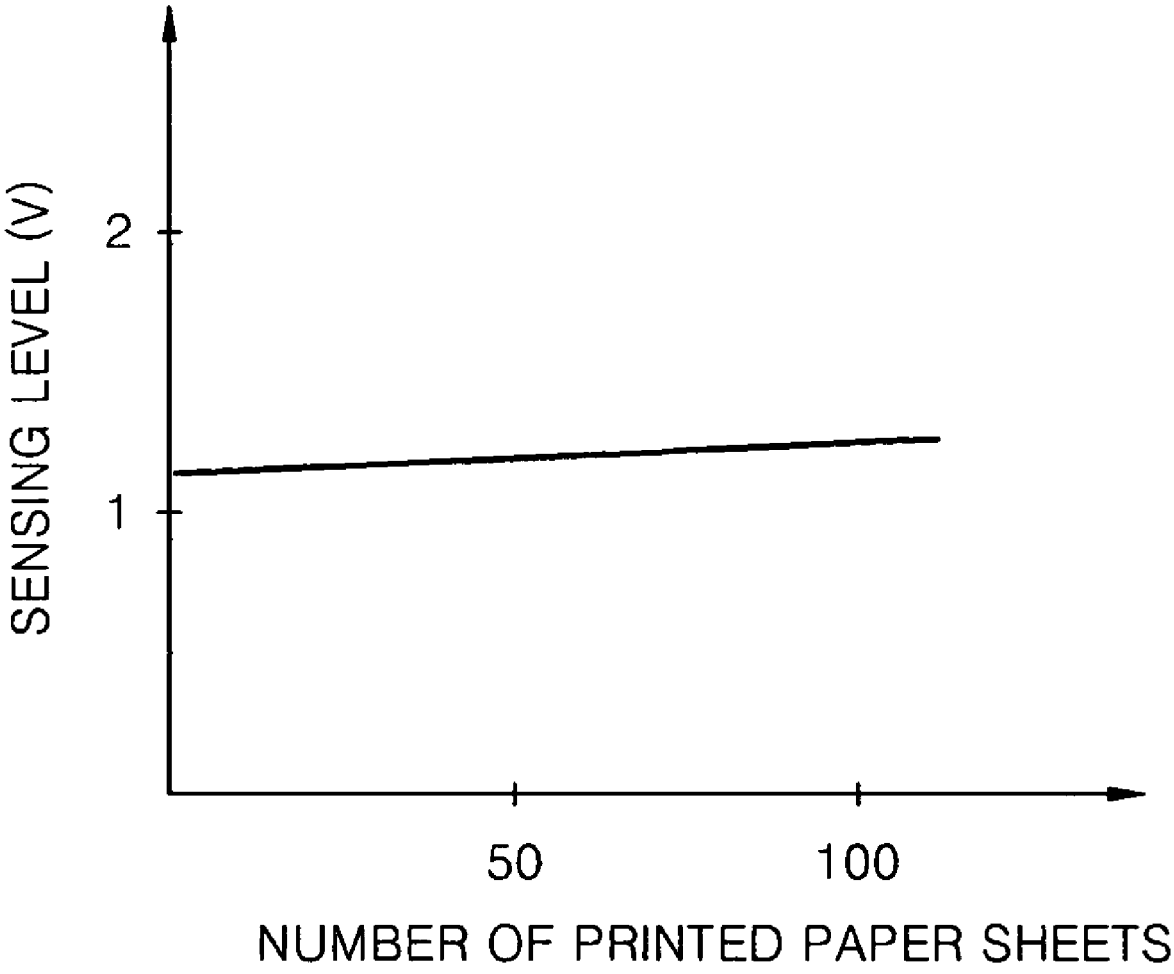
FIG. 4 is a graph showing a sensing level of developer using the developing unit of FIG. 1.

FIG. 4 shows a result of measuring a light signal received by the light receiving element of the apparatus to detect developer level when a developing operation is performed in a section where developer is in a normal state. According to FIG. 4, it may be precisely detected that the developer level is gradually reduced. That is, if the developer is stuck on the light emitting window 153 or the light receiving window 163 and errors occur, a light receiving signal shows a difference. That is, because a clean state is always maintained, a state where the remaining amount of the developer is gradually reduced, that is, a state where the amount of detected light is gradually increased, may be precisely detected. Thus, the remaining amount of developer may be substantially prevented from being wrongly detected and printing defects may be substantially prevented from occurring.

As described above, by using the antistatic agent and the cleaning blade in the apparatus to detect developer level in a developing unit according to exemplary embodiments of the present invention, because the developer is not stuck on the light receiving window and the light emitting window to which the light signal is transmitted, an accurate light signal may be transmitted from the light emitting window to the light receiving window, thereby substantially preventing printing defects caused by detection errors from occurring.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus to detect developer level in a developer store space of a developing unit, the apparatus comprising:
- a light emitting element to irradiate light into the developer store space;
- a light receiving element to receive light from the light emitting element through the developer store space;
- an antistatic agent coated on a window connected to the light emitting element and a window connected to the light receiving element, respectively, to substantially prevent developer from attaching to the window connected to the light emitting element and/or the window connected to the light receiving element; and
- a light emitting prism and a light receiving prism installed in the developer store space forming a light emitting path and a light receiving path, respectively,
- wherein the window connected to the light emitting element and the window connected to the light receiving element belong to the light emitting prism and the light receiving prism, respectively.

2. The apparatus of claim 1, wherein the antistatic agent is polythiophene- based pigments diluted in distilled water or isopropyl alcohol.

3. The apparatus of claim 1, wherein a surface resistance of the antistatic agent is less than approximately $10^5$ ohm/mm$^2$.

4. The apparatus of claim 1, wherein a coating thickness of the antistatic agent is less than approximately 5.0 μm.

5. The apparatus of claim 1, wherein a remaining amount of developer is determined according to a range of an amount of received light detected by the light receiving element.

6. The apparatus of claim 1, further comprising a cleaning tool to clean the light emitting window and the light receiving window.

7. The apparatus of claim 6, wherein the cleaning tool comprises a cleaning blade connected to a rotating member to contact the light emitting window and the light receiving window, respectively, to clean the light emitting window and the light receiving window according to the rotation of the rotating member.

8. The apparatus of claim 7, wherein the rotating member is an auger rotating in a developer store space and conveying the developer in a predetermined direction.

9. The apparatus of claim 7, wherein the cleaning blade is made of rubber.

10. The apparatus of claim 1, wherein a developer supplying member is connected to a body of the developing unit to supply developer to the developer store space.

11. An apparatus to detect developer level in a developer store space of a developing unit, the apparatus comprising:
- a body having a developer store space adapted to receive developer;
- a light emitting element to irradiate light into the developer store space;
- a light receiving element to receive light from the light emitting element through the developer store space;
- an antistatic agent coated on a window connected to the light emitting element and a window connected to the light receiving element, respectively, to substantially prevent developer from attaching to the window connected to the light emitting element and/or the window connected to the light receiving element; and
- a light emitting prism and a light receiving prism installed in the developer store space forming a light emitting path and a light receiving path, respectively;
- wherein the window connected to the light emitting element and the window connected to the light receiving element belong to the light emitting prism and the light receiving prism, respectively.

12. The apparatus of claim 11, wherein the antistatic agent is polythiophene- based pigments diluted in distilled water or isopropyl alcohol.

13. The apparatus of claim 11, wherein a surface resistance of the antistatic agent is less than approximately $10^5$ ohm/mm$^2$.

14. The apparatus of claim 11, wherein a coating thickness of the antistatic agent is less than approximately 5.0 μm.

15. The apparatus of claim 11, wherein a remaining amount of developer is determined according to a range of an amount of emitted light detected by the light receiving element.

16. The apparatus of claim 11, further comprising a cleaning tool to clean the light emitting and the light receiving windows.

17. The apparatus of claim 16, wherein the cleaning tool comprises a cleaning blade connected to a rotating member to contact the light emitting and light receiving windows to clean the light emitting and light receiving windows according to the rotation of the rotating member.

18. The apparatus of claim 17, wherein the rotating member is an auger rotating in the developer store space and conveying the developer in a predetermined direction.

19. The apparatus of claim 17, wherein the cleaning blade is made of rubber.

20. The apparatus of claim 11, wherein a developer supplying member is connected to the body of the developing unit to supply developer to the developer store space.

21. An image forming apparatus, comprising:
- a photosensitive body;
- a developing unit to supply developer to the photosensitive body, the developing unit including a body having a developer store space adapted to receive developer;

a light emitting element to irradiate light into the developer store space;

a light receiving element to receive light from the light emitting element through the developer store space;

an antistatic agent coated on a window connected to the light emitting element and a window connected to the light receiving element, respectively, to substantially prevent developer from attaching to the window connected to the light emitting element and/or the window connected to the light receiving element; and a light emitting prism and a light receiving prism installed in the developer store space forming a light emitting path and a light receiving path, respectively, wherein the window connected to the light emitting element and the window connected to the light receiving element belong to the light emitting prism and the light receiving prism, respectively.

22. The apparatus of claim 21, wherein the antistatic agent is polythiophene- based pigments diluted in distilled water or isopropyl alcohol.

23. The apparatus of claim 21, wherein a surface resistance of the antistatic agent is less than approximately $10^5$ ohm/$mm^2$.

24. The apparatus of claim 21, wherein a coating thickness of the antistatic agent is less than approximately 5.0 μm.

25. The apparatus of claim 21, wherein a remaining amount of developer is determined according to a range of an amount of emitted light detected by the light receiving element.

26. The apparatus of claim 21, further comprising a cleaning tool to clean the light emitting and the light receiving windows.

27. The apparatus of claim 26, wherein the cleaning tool comprises a cleaning blade connected to a rotating member to contact the light emitting and light receiving windows to clean the light emitting and light receiving windows according to the rotation of the rotating member.

28. The apparatus of claim 27, wherein the rotating member is an auger rotating in the developer store space and conveying the developer in a predetermined direction.

29. The apparatus of claim 27, wherein the cleaning blade is made of rubber.

30. The apparatus of claim 21, wherein a developer supplying member is connected to the body of the developing unit to supply developer to the developer store space.

* * * * *